US008276906B2

(12) United States Patent
Yamamoto

(10) Patent No.: US 8,276,906 B2
(45) Date of Patent: Oct. 2, 2012

(54) IMAGE FORMING DEVICE HAVING IMPROVED SHEET FEEDING MECHANISM

(75) Inventor: Tomoya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/974,150

(22) Filed: Dec. 21, 2010

(65) Prior Publication Data

US 2011/0180985 A1 Jul. 28, 2011

(30) Foreign Application Priority Data

Jan. 28, 2010 (JP) ..... 2010-017073

(51) Int. Cl.
*B65H 1/08* (2006.01)

(52) U.S. Cl. ..... 271/127; 271/156

(58) Field of Classification Search ..... 271/117, 271/118, 126, 127, 147, 152, 156
See application file for complete search history.

(56) References Cited

U.S. PATENT DOCUMENTS

| | | | | |
|---|---|---|---|---|
| 5,501,444 | A | 3/1996 | Yukimachi et al. | |
| 5,775,686 | A * | 7/1998 | Miyake | 271/127 |
| 6,994,341 | B2 * | 2/2006 | Aoki et al. | 271/117 |
| 7,457,580 | B2 * | 11/2008 | Kitamura | 399/393 |
| 7,984,902 | B2 * | 7/2011 | Kuroda | 271/156 |
| 2005/0087921 | A1 * | 4/2005 | Aoki et al. | 271/126 |
| 2006/0180986 | A1 | 8/2006 | Hattori | |
| 2009/0200729 | A1 * | 8/2009 | Okamoto | 271/117 |
| 2010/0104311 | A1 * | 4/2010 | Okamoto | 399/75 |

FOREIGN PATENT DOCUMENTS

| | | |
|---|---|---|
| JP | 07-053065 A | 2/1995 |
| JP | 2006-176321 | 7/2006 |
| JP | 2007-269462 | 10/2007 |
| JP | 2009-007118 A | 1/2009 |
| JP | 2010-105768 | 5/2010 |

OTHER PUBLICATIONS

JP Decision to Grant dated Nov. 15, 2011, corresponding Application 2010-017073; English Translation.

* cited by examiner

*Primary Examiner* — Jeremy R Severson
(74) *Attorney, Agent, or Firm* — Banner & Witcoff, Ltd.

(57) ABSTRACT

An image forming device includes a pickup roller, a planetary gear mechanism having an input gear, trigger and an output gear, lift mechanism, a cam member, a change-over member, and a stop assembly. The change-over member includes a first arm movable between a first position engaging with the trigger for transmitting rotation of the input gear to the output gear and a second position disengaging from the trigger for stopping transmission of rotation from the input gear to the output gear. The second arm is contactable with the cam member for moving the first arm between the first and second positions with movement of the pickup roller. The stop assembly includes a third arm movable between a third position engageable with and a fourth position disengageable from the output gear, and a fourth arm contactable with the cam member for moving the third arm between the third and fourth positions.

8 Claims, 14 Drawing Sheets

STOPPING POSITION OF PRESSURE PLATE

ELEVATING POSITION OF PRESSURE PLATE

IMAGE FORMING DEVICE HAVING IMPROVED SHEET FEEDING MECHANISM

CROSS REFERENCE TO RELATED APPLICATION

This application claims priority from Japanese Patent Application No. 2010-017073 filed Jan. 28, 2010. The entire content of the priority application is incorporated herein by reference.

TECHNICAL FIELD

The present invention relates to an image forming device. More specifically, the present invention relates to improvement of a sheet feeding mechanism that conveys sheets on a sheet-by-sheet basis.

BACKGROUND

A conventional electrophotographic type image forming device is provided with a sheet supply roller (pick up roller). The sheet supply roller contacts an uppermost sheet of stacked sheets in a sheet supply tray in order to supply sheets to an image forming unit on a sheet-by-sheet basis. It is important for the sheet supply roller to be pressed against the sheet stack at a predetermined pressure in order to supply sheets to the image forming unit on a sheet-by-sheet basis. However, the sheets are consumed one after another as images are formed, and a height of the uppermost sheet is gradually lowered. Thus, in order to maintain pressure of the sheet supply roller against the sheet stack, there is a need to provide a mechanism for elevating the height of the uppermost sheet of the sheet stack or a mechanism for moving the sheet supply roller downward in association with consumption of the sheets.

Laid-open Japanese Patent Application Publication No. 2007-269462 discloses an image forming device in which a drive force transmission mechanism is provided to transmit a drive force to a stack plate (pressure plate) in a sheet supply tray via an acting member in order to elevate the stack plate. The drive force transmission mechanism has a one-way clutch for regulating the stack plate from being displaced downwardly. In this image forming device, the one-way clutch is employed to prevent the stack plate from moving downward due to a weight of recording sheets stacked on the stack plate even when the drive force is not transmitted to the stack plate.

SUMMARY

However, if a commercially available one-way clutch is used, the stack plate accidentally moves downward because of backlash of the one-way clutch. In the image forming device described above, after the drive force for elevating the stack plate has been cut off, the stack plate moves downward by 0.8 mm.

In view of the foregoing, it is an object of the present invention to provide an image forming device capable of preventing downward movement of a pressure plate without using a one-way clutch.

In order to attain the above and other objects, the present invention provides an image forming device including: a main frame; a sheet supply tray; a pressure plate; a pick-up roller; a planetary gear mechanism; a drive source; a lift mechanism; a cam member; a change-over member; and a stop assembly. The sheet supply tray is assembled to the main frame for mounting a stack of sheets. The pressure plate is positioned immediately below the stack of sheets and movable to a stopping position and to an elevated position for lifting the stack of sheets upward at a sheet supplying timing. The pick-up roller is positioned above the sheet supply tray and in contact with an uppermost sheet of the sheet stack mounted on the sheet supply tray for supplying the uppermost sheet. The pick-up roller is movable upward and downward in accordance with an amount of the sheets of the sheet stack. The planetary gear mechanism includes an input gear, an output gear, and a trigger member that selectively transmits rotation of the input gear to the output gear. The drive source is engaged with the input gear to rotate the input gear. The lift mechanism is engaged with the output gear to convert the rotary motion of the output gear to lifting motion of the pressure plate. The cam member is rotatably supported to the main frame and has a cam portion. The change-over member is pivotally movably supported to the main frame. The change-over member includes a first arm and a second arm. The first arm is movable between a first position engaging with the trigger member for transmitting rotation of the input gear to the output gear and a second position disengaging from the trigger member for shutting off the transmission of rotation from the input gear to the output gear. The second arm is contactable with the cam portion for moving the first arm between the first position and the second position in accordance with the movement of the pickup roller. The stop assembly is pivotally movably supported to the main frame independent of the pivotal movement of the change-over member. The stop assembly includes a third arm and a fourth arm. The third arm is pivotally movable between a third position engageable with the output gear for stopping rotation thereof and a fourth position disengaging from the output gear for permitting rotation of the output gear. The fourth arm is contactable with the cam portion for moving the third arm between the third position and the fourth position in accordance with the movement of the pickup roller. The cam portion has a cam profile configured to position the first arm at the second position and to position the third arm at the third position when the pressure plate is at the stopping position at a stopping phase of rotation of the cam portion, and to position the first arm at the first position after the start of rotation of the cam portion, and then to position the third arm at the fourth position, and to again position the third arm at the third position with maintaining the first position of the first arm after the temporary rotation stop phase and the rotation restart phase, and then to position the first arm at the second position

BRIEF DESCRIPTION OF THE DRAWINGS

The particular features and advantages of the invention as well as other objects will become apparent from the following description taken in connection with the accompanying drawings, in which.

DETAILED DESCRIPTION

<General Structure of Laser Printer>

Figure 1:
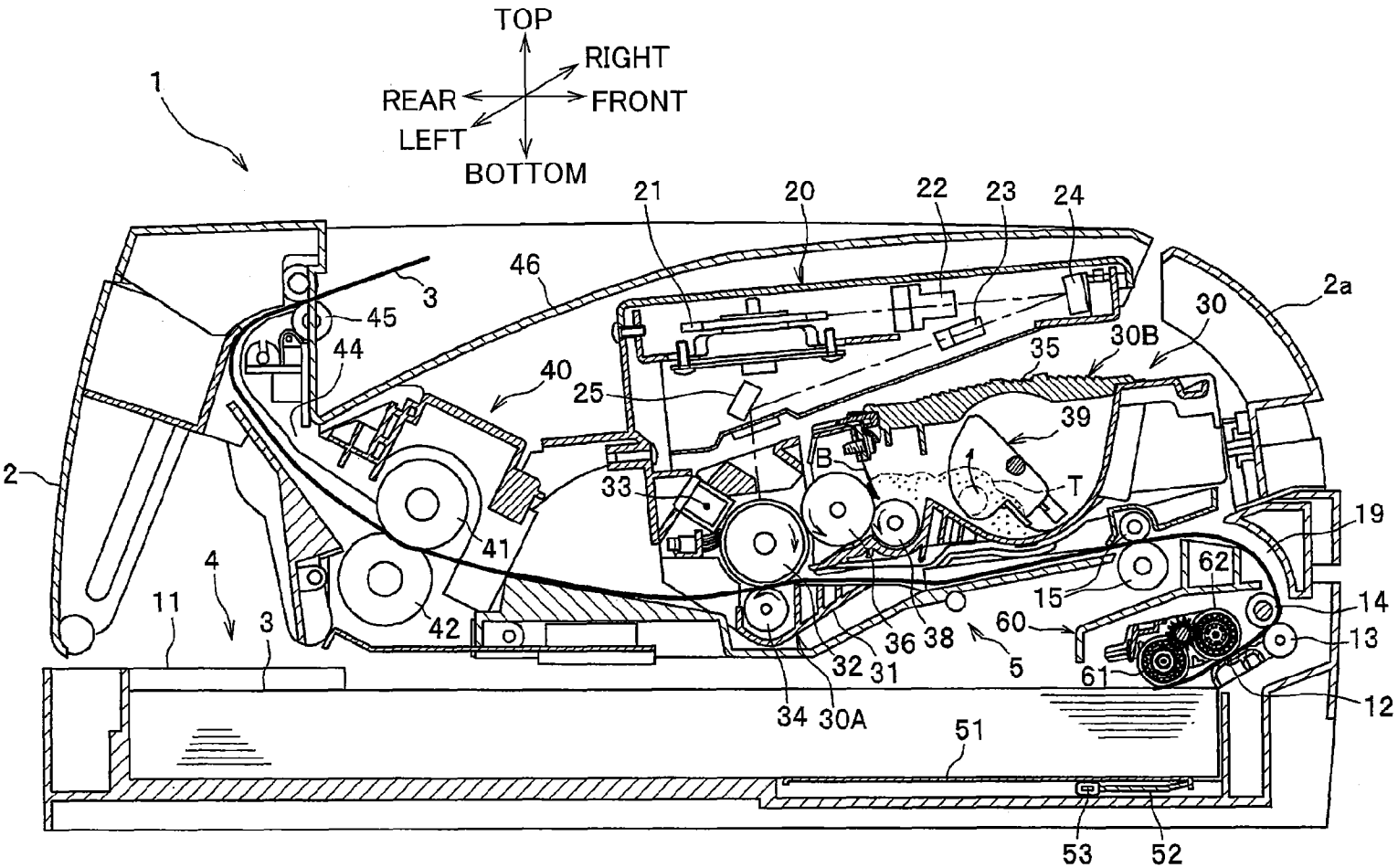
FIG. 1 is a schematic cross-sectional view showing substantial parts and components of a laser printer according to one embodiment of the present invention.

A laser printer 1 as an image forming device according to one embodiment of the present invention will be described while referring to the accompanying drawings wherein like parts and components are designated by the same reference numerals to avoid duplicating description.

As shown in FIG. 1, the laser printer 1 includes a main casing 2 with a movable front cover 2*a*. Within the main casing 2, a feeder unit 4 for feeding a sheet 3 accommodated in the main casing 2, and an image forming unit 5 for forming an image on the sheet 3 are provided.

The terms "above", "below", "right", "left", "front", "rear" and the like will be used throughout the description assuming that the laser printer 1 is disposed in an orientation in which it is intended to be used. More specifically, in FIG. 1 a left side and a right side are a rear side and a front side, respectively.

The front cover 2*a* is positioned at a front side of the main casing 2 so as to cover an opening formed in the main casing 2 when the front cover 2*a* is at its closed position and to expose the opening when the front cover 2*a* is at its open position. A process cartridge 30 described later is detachable from or attachable to the main casing 2 through the opening when the front cover 2*a* is at the open position.

<Structure of Feeder Unit>

The feeder unit 4 includes a sheet supply tray 11, a pressure plate 51, and a lifter plate 52. The sheet supply tray 11 is detachably mounted at a lower portion of the main casing 2. The pressure plate 51 is disposed immediate below the sheet 3 at a lower portion of the sheet supply tray 11. The pressure plate 51 is pivotally movable so that a front end thereof can be lifted up, thereby lifting up the sheet 3 when the sheet 3 is conveyed to the image forming unit 5. The lifter plate 52 is disposed immediate below the pressure plate 51 to lift up the pressure plate 51 from below. The lifter plate 52 has a rear end portion 53 that is pivotally supported to the sheet supply tray 11. As described later, a driving force from a main body is transmitted to the lifter plate 52 so the lifter plate 52 is pivotally rotated about the rear end portion 53 to lift up the pressure plate 51. Note that, throughout the description, the "main body" implies a portion in which the sheet supply tray 11, and parts and components assembled to the sheet supply tray 11 are omitted from the laser printer 1.

The feeder unit 4 includes a pickup roller 61 disposed above and frontward of the sheet supply tray 11 and a separation roller 62 disposed frontward of the pickup roller 61. The pickup roller 61 contacts an uppermost sheet of sheets stacked in the sheet supply tray 11 from above. The separation roller 62 is arranged in confrontation with a separation pad 12 assembled to the sheet supply tray 11. The feeder unit 4 further includes a paper dust removing roller 13 and a confronting roller 14. The paper dust removing roller 13 and the confronting roller 14 are disposed frontward of the separation roller 62, and arranged in confrontation with each other. After the sheet 3 has passed between the paper dust removing roller 13 and the confronting roller 14, the sheet 3 is conveyed rearward of the main casing 2 along a conveying path 19. The feeder unit 4 further includes a pair of registration rollers 15 disposed above the pickup roller 61.

In the feeder unit 4 with the structure described above, the sheets 3 stacked in the sheet supply tray 11 are lifted up by the lifter plate 52 and the pressure plate 51, and the uppermost sheet 3 of the sheet stack in the sheet supply tray 11 is conveyed toward the separation roller 62 by the pickup roller 61, and a frictional force between the separation roller 62 and the separation pad 12 discharges the uppermost sheet 3 toward the confronting roller 14 to convey the uppermost sheet 3 to the image forming unit 5 on a sheet-by-sheet basis.

<Structure of Image Forming Unit>

The image forming unit 5 includes a scanning unit 20, the process cartridge 30, and a fixing unit 40.

<Structure of Scanning Unit>

The scanning unit 20 is positioned at an upper portion of the main casing 2. The scanning unit 20 includes a laser emission unit (not shown), a rotatably driven polygon mirror 21, lenses 22, 23, and reflecting mirrors 24, 25. The laser emission unit is adapted to project a laser beam based on image data so that the laser beam is deflected by or passes through the polygon mirror 21, the lens 22, the reflecting mirror 24, the lens 23, and the reflecting mirror 25 in this order (indicated by a chain line in FIG. 1). A surface of a photosensitive drum 32 is subjected to high speed scan of the laser beam.

<Structure of Process Cartridge>

The process cartridge 30 is disposed immediate below the scanning unit 20. The process cartridge 30 is detachably mounted to the main casing 2. The process cartridge 30 includes a photosensitive cartridge 30A supporting the photosensitive drum 32, and a developer cartridge 30B detachably mounted to the photosensitive cartridge 30A and accommodating toner as a developing agent therein.

The photosensitive cartridge 30A includes a cartridge casing 31 constituting an outer frame thereof. Within the cartridge casing 31, the photosensitive drum 32, a scorotron charger 33 and a transfer roller 34 are provided.

The developer cartridge 30B is detachably mounted to the photosensitive cartridge 30A. The developer cartridge 30B includes a developer casing 35 accommodating the toner therein. Within the developer casing 35, a developing roller 36, a supply roller 38, and an agitator 39. The developing roller 36, the supply roller 38 and the agitator 39 are rotatably supported to the developer casing 35. Toner T accommodated in the developer casing 35 is supplied to the developing roller 36 by rotation of the supply roller 38 in the counterclockwise direction (indicated by an arrow in FIG. 1). At this time, the toner T is positively tribocharged between the supply roller 38 and the developing roller 36. As the developing roller 36 rotates, the toner T supplied onto the developing roller 36 is conveyed between a blade B for regulating a layer thickness and the developing roller 36, so that the developing roller 36 retains a uniform thin layer of toner thereon.

The photosensitive drum 32 is rotatably supported to the cartridge casing 31 to which the developer cartridge 30B is mounted, and rotatable in the clockwise direction (indicated by an arrow in FIG. 1). The photosensitive drum 32 is electrically grounded. The surface of the photosensitive drum 32 is formed with a photosensitive layer of positive polarity.

The scorotron charger 33 is disposed diagonally above and rearward of the photosensitive drum 32. The scorotron charger 33 is arranged in confrontation with and spaced away from the photosensitive drum 32 at a predetermined distance, so as not to contact the photosensitive drum 32. The scorotron charger 33 has a charging wire formed of tungsten to generate corona discharge so that the surface of the photosensitive drum 32 can be uniformly charged to have a positive polarity.

The transfer roller 34 is disposed below the photosensitive drum 32 and arranged in confrontation with the photosensitive drum 32 so as to contact the photosensitive drum 32. The transfer roller 34 is rotatably supported to the cartridge casing 31, and rotatable in the counterclockwise direction (indicated by an arrow in FIG. 1). The transfer roller 34 has a roller shaft formed of metal with which an electrically conductive rubber material is coated. A transfer bias is applied to the transfer roller 34 by a constant current control when transferring on the sheet 3 a toner image formed on the surface of the photosensitive drum 32.

After the surface of the photosensitive drum 32 has been uniformly charged to have a positive polarity by the scorotron charger 33, the surface is subjected to high speed scan of the laser beam emitted from the scanning unit 20. As a result, electrical potential at a portion irradiated with the laser beam is changed. Accordingly, an electrostatic latent image based on image date is formed. Here, the "electrostatic latent image" implies a portion with low electrical potential by being irradiated with the laser beam within the surface of the photosensitive drum 32 uniformly charged to have a positive polarity. When the toner T carried on the developing roller 36 is brought into contact with the photosensitive drum 32 in association with rotation of the developing roller 36, the toner T is supplied to the electrostatic latent image formed on the surface of the photosensitive drum 32. The toner T is selectively carried on the surface of the photosensitive drum 32, so that a visible toner image can be formed on the surface of the photosensitive drum 32 by a reversal phenomenon.

The photosensitive drum 32 and the transfer roller 34 are rotatably driven so as to pinch the sheet 3 therebetween to convey the sheet 3. The sheet 3 is conveyed between the photosensitive drum 32 and the transfer roller 34, so that the visible toner image carried on the surface of the photosensitive drum 32 is transferred onto the sheet 3.

<Structure of Fixing Unit>

The fixing unit 40 is positioned downstream of the process cartridge 30. The fixing unit 40 includes a heat roller 41 and a pressure roller 42. The pressure roller 42 is arranged in confrontation with the heat roller 41, and pinches the sheet 3 in cooperation with the heat roller 41. In the fixing unit 40 configured as described above, the toner T transferred onto the sheet 3 is thermally fixed while the sheet 3 passes between the heat roller 41 and the pressure roller 42. Then, the sheet 3 is conveyed to a discharge path 44. The sheet 3 conveyed to the discharge path 44 is discharged onto a discharge tray 46 by a discharge roller 45.

<Detailed Structure of Feeder Unit>

The feeder unit 4 will be described with reference to FIGS. 2 and 3 in which a sheet 3 is not shown for the purpose of simplicity.

As shown in FIG. 2, the pickup roller 61 is rotatably supported in a holder 65, and a driving force from a power transmission gear mechanism G is transmitted to the pickup roller 61 through a separation roller shaft 62*b*. Further, upward and downward movement of the pickup roller 61 is transmitted to the power transmission gear mechanism G through a lift arm 71, and the pickup roller 61 is urged downward by the lift arm 71.

A pickup roller assembly 60 includes the pickup roller 61 and the holder 65. The pickup roller assembly 60 is pivotally movable about the separation roller shaft 62*b*, and is spaced away from an uppermost sheet of the sheet stack on the sheet supply tray 11 when the sheet supply tray 11 is assembled into the main body. Upon driving the pressure plate 51 lifts the stack of sheets 3 upward, whereupon the pickup roller 61 is pressed upward by the sheet stack. The elevating motion of the pressure plate 51 will be terminated when the pickup roller 61 is lifted to a predetermined height. Further, if the pickup roller 61 is moved downward in accordance with the supply of the several numbers of sheets 3 from the sheet supply tray 11, the pressure plate 51 is again moved upward to elevate the sheet stack to the predetermined height. That is, the pickup roller 61 functions as a sensor for maintaining an uppermost position of the sheet 3. Such operation will be described later in terms of mechanical standpoint, and such construction is described in Laid-Open Japanese Patent Application Publication No. 2006-176321 (corresponding to U.S. Patent Application Publication No. 200610180986A1).

[Power Transmission from Separation Roller Drive Gear to Pickup Roller]

Power transmission from a separation roller drive gear to the pickup roller will be described. The pickup roller 61 is drivingly connected to the separation roller shaft 62*b* through gear trains (not shown). A separation roller drive gear 62*c* is coupled to a left end portion of the separation roller 62. A driving force input gear 110 is provided as a drive source, and the driving force from the driving force input gear 110 is transmitted to the separation roller drive gear 62*c* through a plurality of idle gears (not shown). The pickup roller 61 is rotated only during the sheet supplying duration as described in Laid-Open Japanese Patent Application Publication No. 2006-176321 (corresponding to U.S. Patent Application Publication No. 2006/0180986A1). The separation roller shaft 62*b* is assembled to the main body, and the pickup roller assembly 60 is also assembled to the main body via the separation roller shaft 62*b*.

The lift arm 71 has a central fulcrum point 71*a* about which the lift arm 71 is pivotally movably supported to the main body (not shown). The lift arm 71 has a right end portion formed with an engagement hole 71*b* engaged with a projecting portion 65*a* of the holder 65. The lift arm 71 has a left end portion 71*c* engaged with the power transmission gear mechanism G. A coil spring 72 is provided for urging the left end portion 71*c* upward. The coil spring 72 has an upper end engaged with the main body (not shown) and a lower end engaged with lift arm 71 at a position near the left end portion 71*c*. Because of the urging force of the coil spring 72, the right end portion of the lift arm 71 is urged downward to urge the pickup roller 61 downward.

[Power Transmission to Pressure Plate]

Power transmission to the pressure plate 51 will next be described. As shown in FIGS. 2 and 3, the power transmission gear mechanism G includes the driving force input gear 110, a first idle gear 111, a clutch gear mechanism 80, a pressure plate lift mechanism 90 and a switching gear 96.

The driving force input gear 110 is coupled to a motor (not shown) and is rotated by the rotation of the motor. The driving force input gear 110 is meshedly engaged with an input gear 81 of the clutch gear mechanism 80 through the first idle gear 111.

Figure 4A:
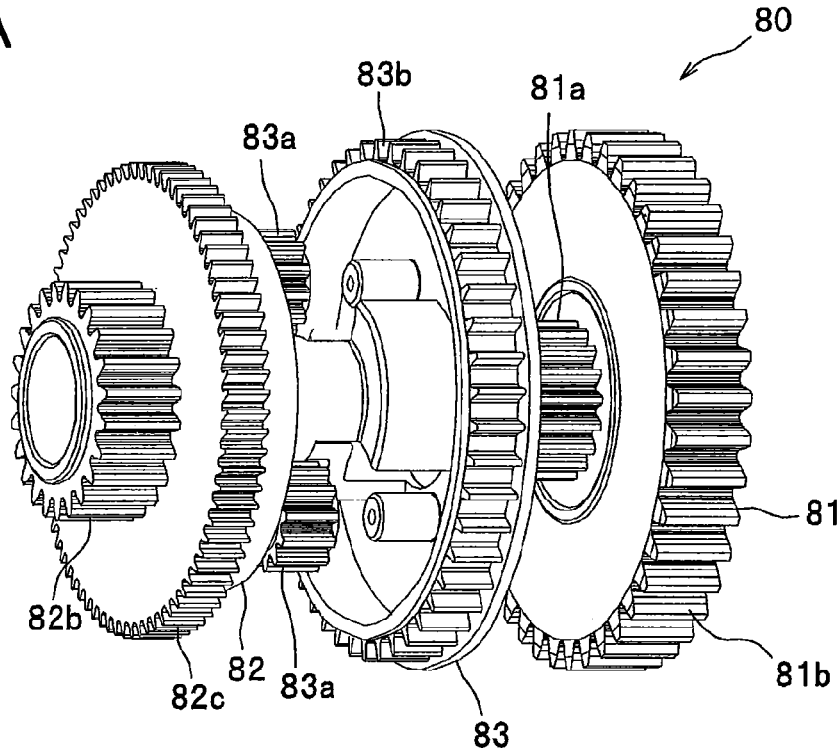
FIG. 4A is an exploded perspective view of a clutch gear mechanism according to the embodiment.
Figure 4B:
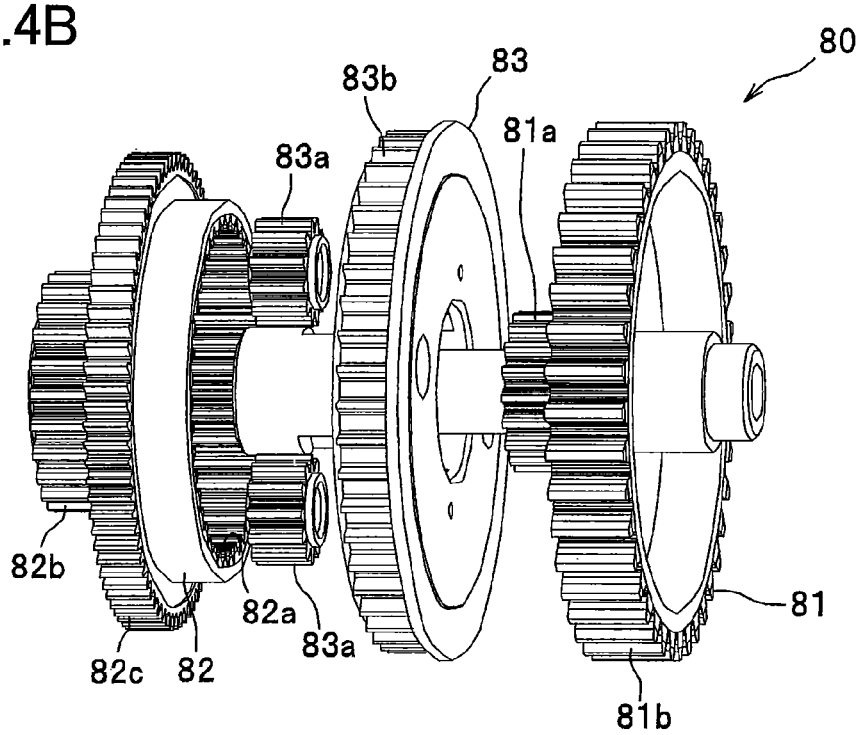
FIG. 4B is an exploded perspective view of the clutch gear mechanism according to the embodiment.

The clutch gear mechanism 80 constitutes a set of gears for controlling the power transmission from the input gear 81 to the pressure plate 51. As shown in FIGS. 4A and 4B, the clutch gear mechanism 80 is a planetary gear mechanism including the input gear 81, an output gear 82, and a trigger 83.

The input gear 81 includes a sun gear 81*a* and external gear teeth 81*b* integrally and concentrically therewith and meshingly engaged with the first idle gear 111. The output gear 82 includes an internal ring gear 82*a*, an output gear teeth 82*b*, and a stop gear teeth 82*c*. The internal ring gear 82*a* is positioned to confront the trigger 83, and the output gear teeth 82*b* is positioned opposite to the internal ring gear 82*a* with respect to the stop gear teeth 82*c*. The stop gear teeth 82*c* has a diameter greater than that of the output gear teeth 82*b* and has gear teeth whose size is smaller than that of the output gear teeth 82*b* and whose number is greater than that of the output gear teeth 82*b*. The stop gear teeth 82*c* does not function as a gear wheel but functions to engage with a stop assembly S (described later) for regulating or controlling the rotation of the output gear 82.

The trigger 83 functions as a carrier in the planetary gear mechanism, and rotatably holds two planetary gears 83*a* meshed with the sun gear 81*a* and the internal ring gear 82*a*. The trigger 83 has trigger teeth 83*b* at its outer peripheral surface. The trigger teeth 83*b* do not function as a gear wheel but are engageable with a change-over member 120 (described later). That is, power transmission from the input gear 81 to the output gear 82 is rendered ON when the change-over member 120 is engaged with the trigger teeth 83*b*, and the power transmission is shut OFF when the change-over member 120 is disengaged from the trigger teeth 83*b*.

As shown in FIGS. 2 and 3, the pressure plate lift mechanism 90 includes a first deceleration gear 91, a second idle gear 92, a second deceleration gear 93, and a lift gear 94. The first deceleration gear 91 has a large diameter gear wheel 91*a* meshed with the output gear teeth 82*b*, and a small diameter gear wheel 91*b* meshed with the second idle gear 92. Therefore, the rotation of the output gear 82 is transmitted to the second idle gear 92.

Figures 2A, 2B:
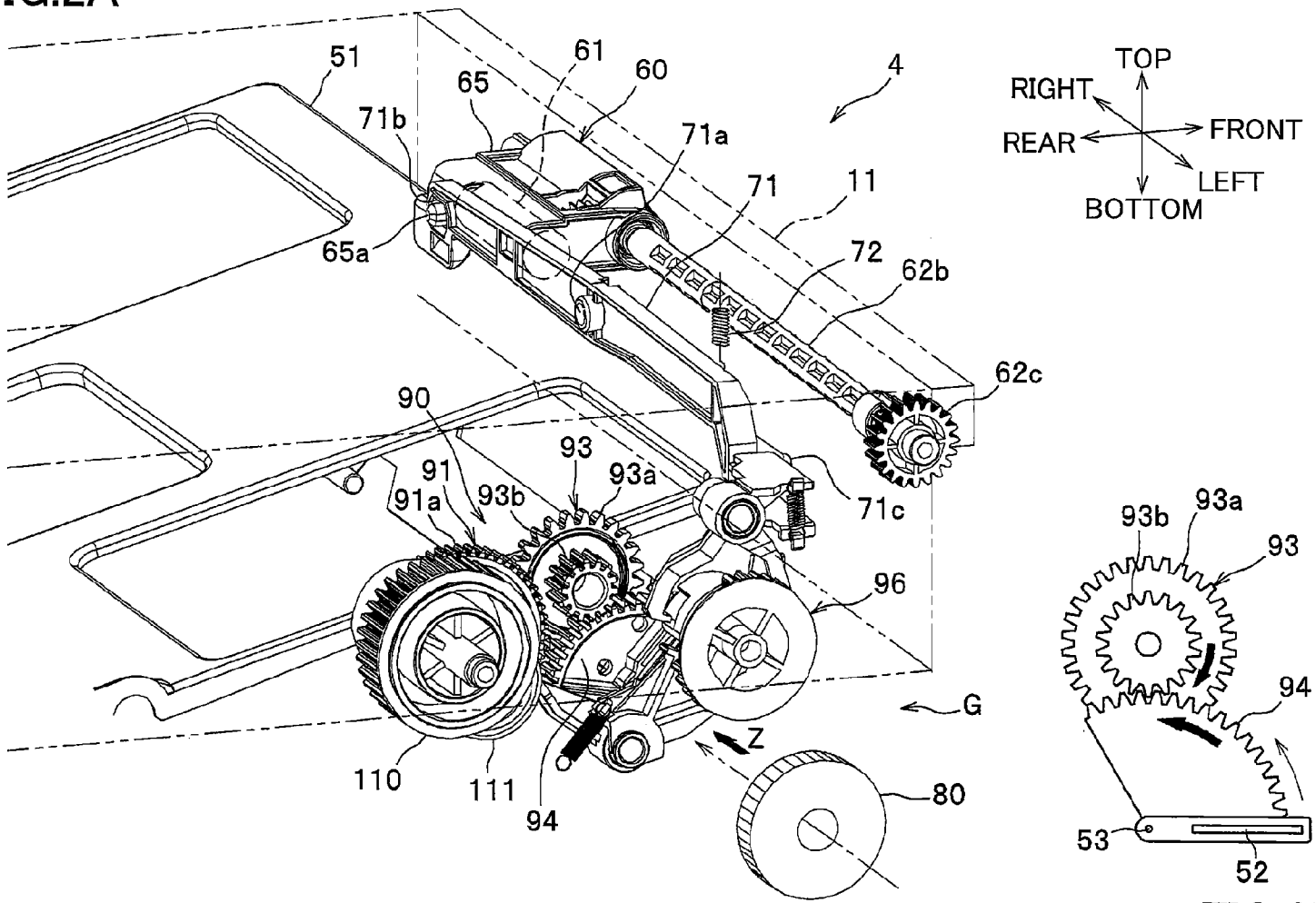
FIG. 2A is a perspective view of a pickup roller, and a power transmission gear mechanism for driving the pickup roller as viewed from a left rear side according to the embodiment.
FIG. 2B is a view as viewed in a direction of an arrow Z of FIG. 2A according to the embodiment.

The second deceleration gear 93 has a large diameter gear wheel 93*a* meshed with the second idle gear 92, and a small diameter gear wheel 93*b* meshed with the lift gear 94. Therefore, rotation of the first deceleration gear 91 is transmitted to the second deceleration gear 93, and the rotation of the second idle gear 92 is transmitted to the lift gear 94, As shown in FIG. 2B, the lift gear 94 has a sector shape having a lower edge portion to which the lifter plate 52 is fixed. The lifter plate 52 has the rear end portion 53 coincident with a pivotal center thereof. Further, a rotation axis of the lift gear 94 is coincident with the pivotal center of the pivot shaft 53. By the angular rotation of the lift gear 94, the pivot shaft 53 is rotated about its axis.

With such structure of the pressure plate lift mechanism 90, rotation of the output gear 82 is transmitted to the first deceleration gear 91, the second idle gear 92, the second deceleration gear 93, and the lift gear 94 in this order to pivotally move the lifter plate 52. When the lifter plate 52 is pivotally moved to its upstanding position, the lifter plate 52 pushes up the pressure plate 51, so that the pressure plate 51 is pivotally moved upward.

[Mechanism for Controlling Movement of Pressure Plate]

Next, a mechanism for controlling movement of the pressure plate 51 will be described. This mechanism is configured to move the pressure plate 51 upward and downward and to terminate the ascent movement of the pressure plate 51 when the pickup roller 61 is moved to its upward sheet supplying position by the pushing force from the pressure plate 51 through the sheet stack.

Figures 3A, 3B:
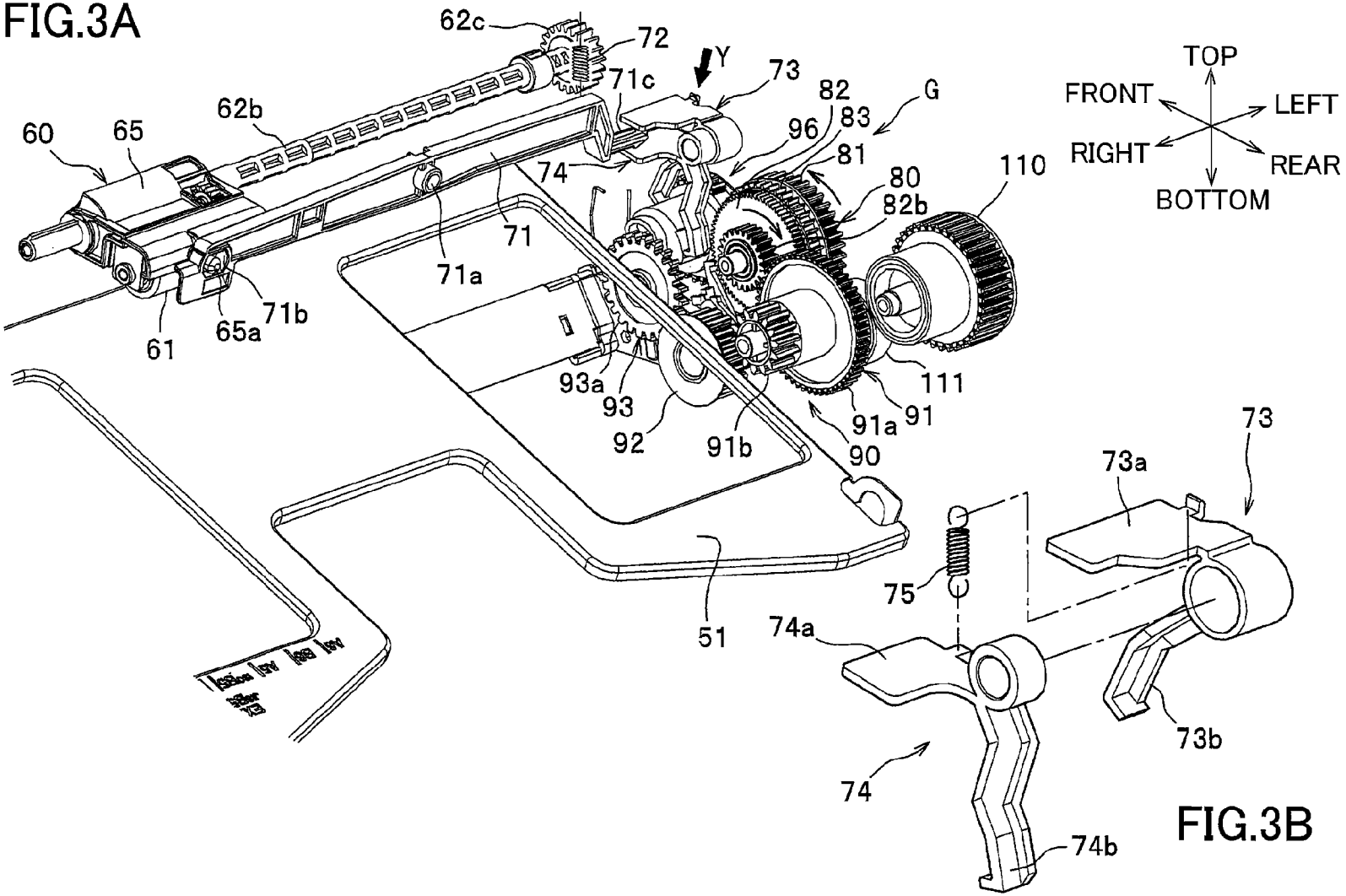
FIG. 3A is a perspective view of the pickup roller, and the power transmission gear mechanism as viewed from a right rear side according to the embodiment.
FIG. 3B is an enlarged exploded view of a portion indicated by an arrow Y of FIG. 3A according to the embodiment.

As shown in FIG. 3A, a first hook 73 is positioned immediately above the left end portion 71*c* of the lift arm 71, and a second hook 74 is positioned immediately below the left end portion 71*c*. As shown in FIG. 3B, the first hook 73 has a front arm 73*a* and a rear arm 73*b*, and the second hook 74 has a front arm 74*a* and a rear arm 74*b*. The first hook 73 and the second hook 74 are pivotally movable about an identical shaft extending from the main body. A coil spring 75 connects the front arm 73*a* to the front arm 74*a*, so that these front arms 73*a* and 74*a* are urged toward each other. Accordingly, pivotal motion of one of the hooks will cause pivotal motion of the remaining one of the hooks.

Figure 5:
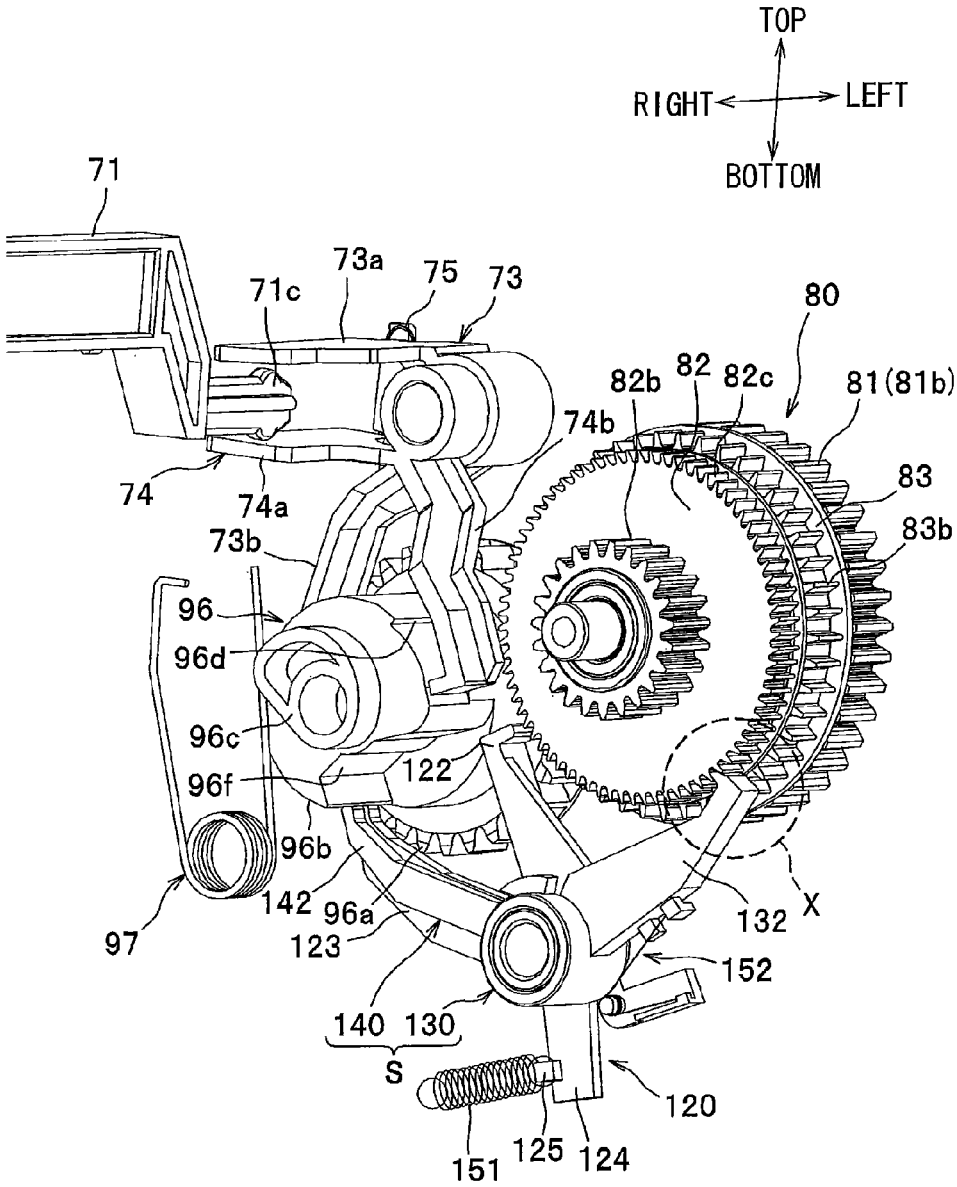
FIG. 5 is a perspective view of a pressure plate controlling mechanism according to the embodiment.
Figure 8:
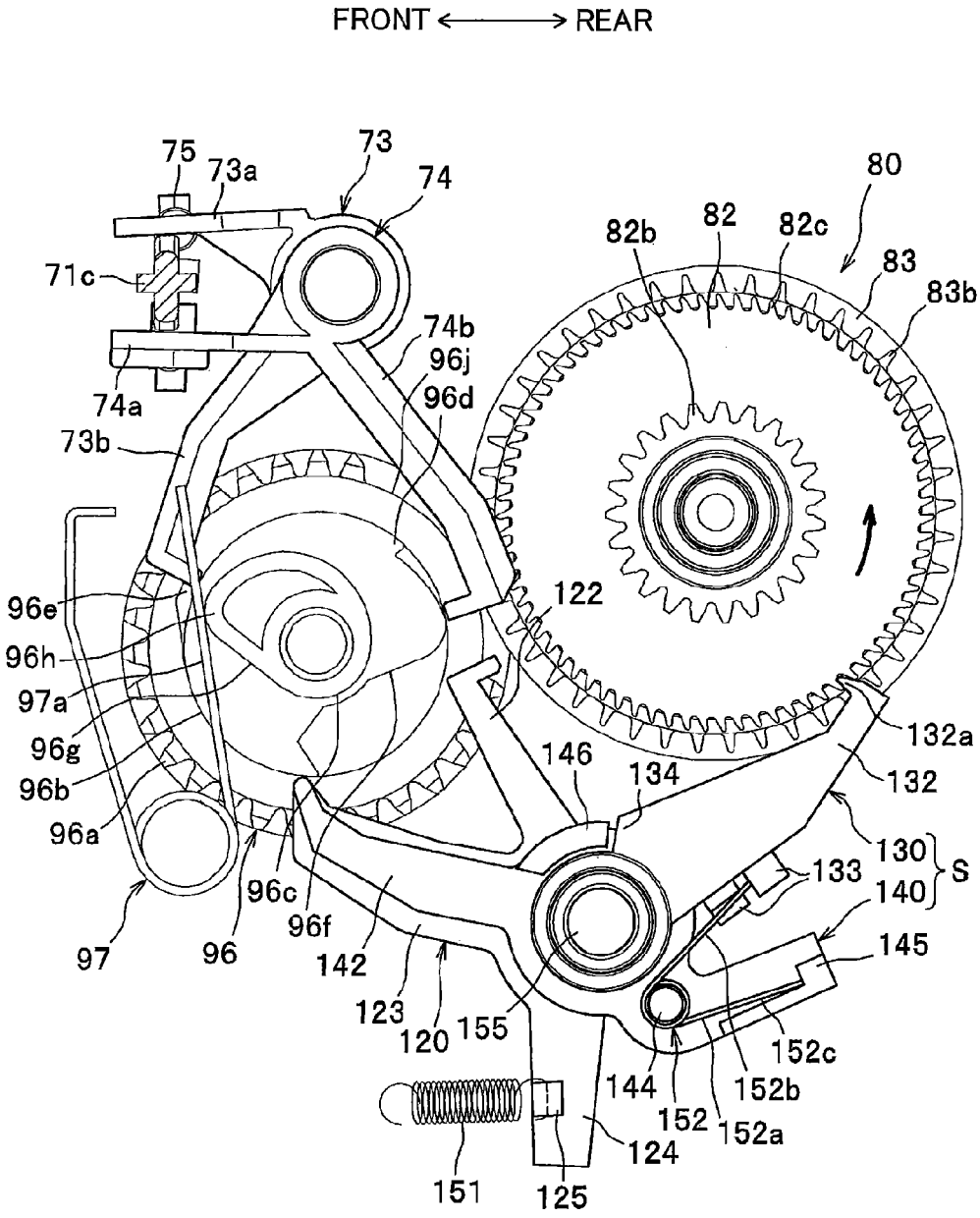
FIG. 8 is an explanatory view showing a state of the pressure plate controlling mechanism at a pressure plate stopping position according to the embodiment.

As shown in FIG. 5, the switching gear 96 has a first cam portion 96*b* having a stepped portion 96*d* and a protruding portion 96*e* (FIG. 8). The rear arms 73*b*, 74*b* have their tip end portions confronting the first cam portion 96*b*. In accordance with change in orientation of the first hook 73 and the second hook 74, these tip end portions can be engaged with or disengaged from the stepped portion 96*d* and the protruding portion 96*e*. Incidentally, in FIG. 8, a cylindrical profile portion of the first cam portion 96*b* will be referred to as a "basic circle".

The switching gear 96 includes a leftmost gear teeth portion 96*a*, the first cam portion 96*b*, and a rightmost second cam portion 96*c*. The gear teeth portion 96*a* has an external teethed region engageable with the external gear teeth 81*b* of the input gear 81, and a non-toothed region 96*j*. Rotation of the input gear 81 is transmitted to the switching gear 96 as long as the input gear 81 is meshingly engaged with the external teethed region.

Figure 10:
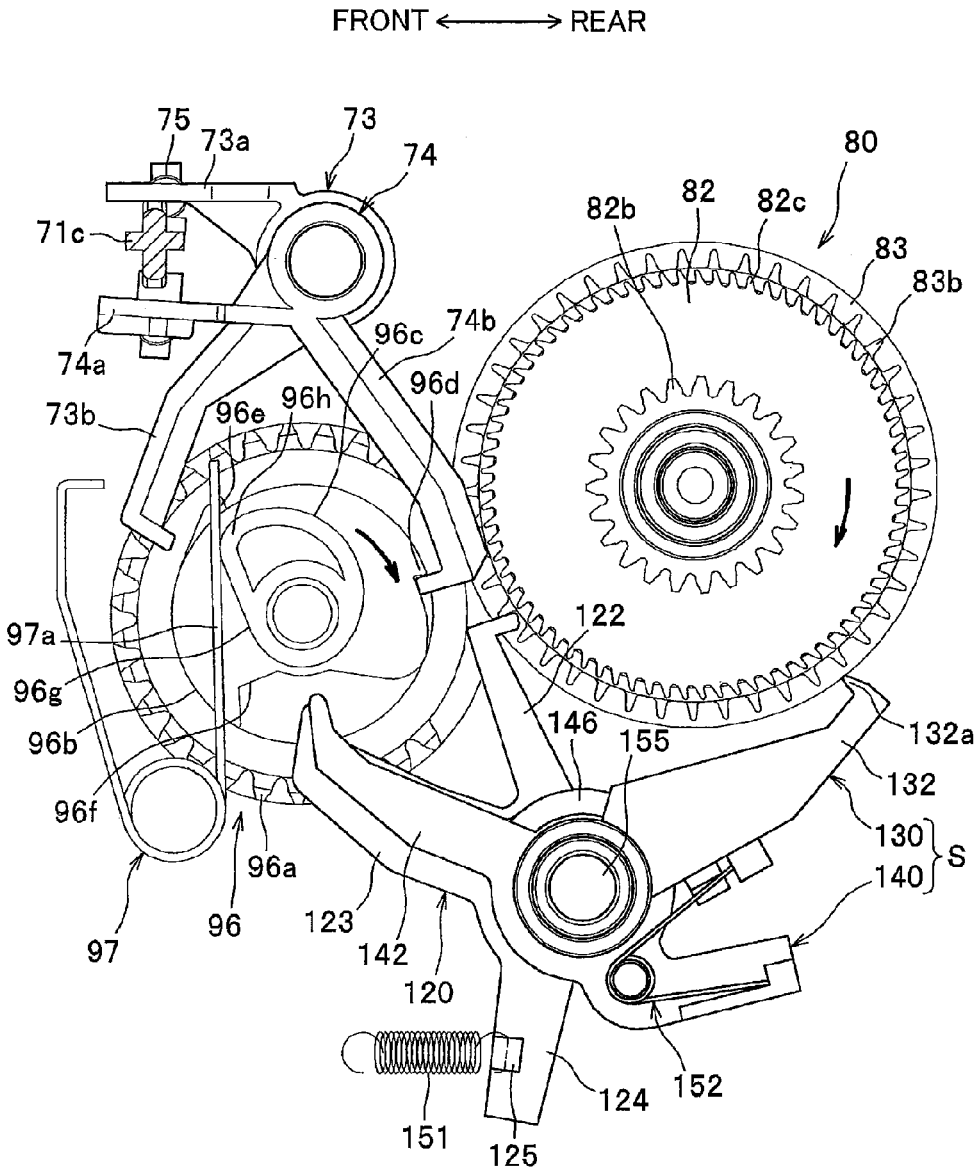
FIG. 10 is an explanatory view showing a state of the pressure plate controlling mechanism at the pressure plate elevating position according to the embodiment.

In the first cam portion 96*b*, the stepped portion 96*d* and the switching gear 96 are provided discontinuous from the gently curved basic circle, and the first cam portion 96*b* is formed with a recessed portion 96*f*. The stepped portion 96*d* is positioned in an axial direction of the switching gear 96 allowing engagement with the tip end portion of the rear arm 74*b*, while preventing the tip end portion of the rear arm 73*b* from engaging the stepped portion 96*d* as shown in FIG. 10. Further, the protruding portion 96*e* is positioned in the axial direction of the switching gear 96 allowing engagement with the tip end portion of the rear arm 73*b*, while preventing the tip end portion of the rear arm 74*b* from engaging the protruding portion 96*e*. In other words, the stepped portion 96*d* can be exclusively aligned with the rear arm 74*b* in the lateral (rightward/leftward) direction, and the protruding portion 96*e* can be exclusively aligned with the rear arm 73*b* in the lateral direction.

The second cam portion 96*c* has a generally egg shaped profile, and has a planar portion 96*g*. An end portion 96*h* is defined at a boundary between the planer portion 96*g* and the remaining portion. A torsion spring 97 is interposed between the main frame and the second cam portion 96*c*. As shown in FIG. 8 when an arm 97*a* of the torsion spring 97 is in abutment with the end portion 96*h*, the torsion spring 97 is urged to be moved toward the planar portion 96*g*, i.e., the torsion spring 97 generates rotation force of the switching gear 96 in a clockwise direction in FIG. 8.

Figure 6A:
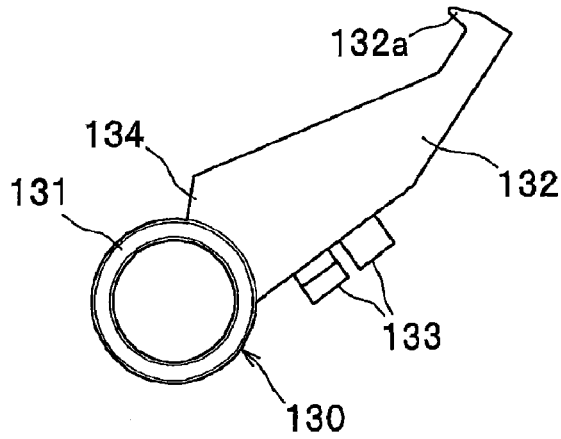
FIG. 6A is a front view of a first stop member according to the embodiment.
Figure 6B:
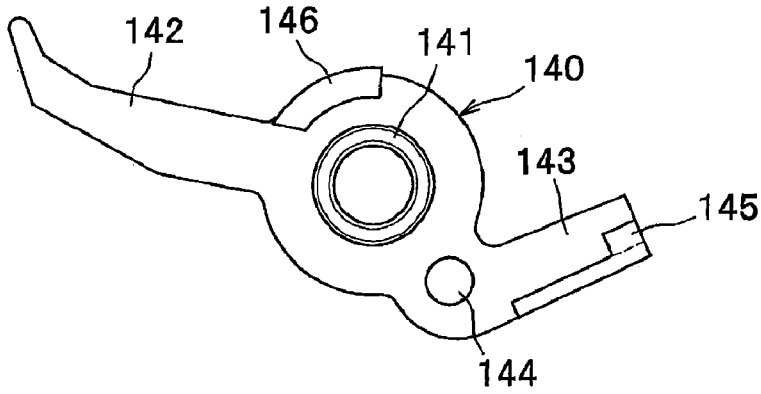
FIG. 6B is a front view of a second stop member according to the embodiment.
Figure 6C:
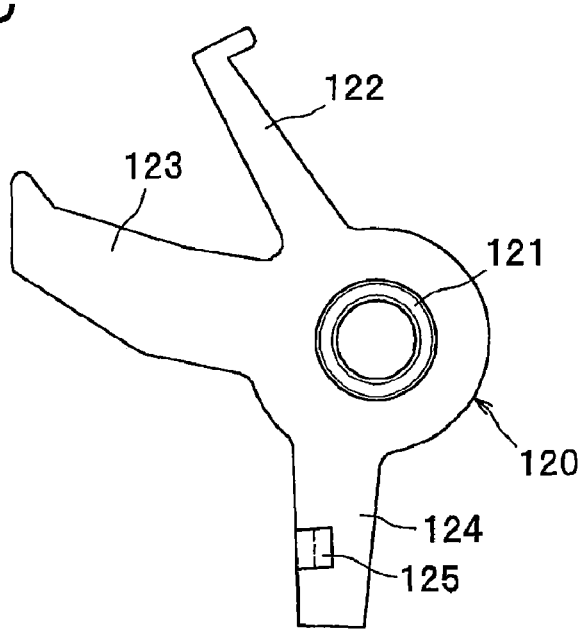
FIG. 6C is a front view of a change-over member according to the embodiment.

As shown in FIGS. 5 and 6, the change-over member 120 is disposed below the output gear 82 of the clutch gear mechanism 80. As shown in FIG. 6, the change-over member 120 includes a shaft portion 121, and first through third arms 122, 123, 124 extending radially outwardly from the shaft portion 121 in directions different from one another. A support shaft 155 (FIG. 8) extends from the main body, and the shaft portion 121 is rotatably supported to the support shaft 155. The first arm 122 has a free end portion positioned in confrontation with the trigger teeth 83*b*, and is selectively engageable therewith in accordance with a pivotal motion of the first arm 122. The second arm 123 extends toward the first cam portion 96*b*, and has a tip end portion contactable with a cam surface of the first cam portion 96*b*. The third arm 124 is a spring-urged arm 124 extending downward. The spring-urged arm 124 has an engagement portion 125.

A spring 151 (urging member) is provided between the main body and the spring-urged arm 124. That is, the spring 151 has one end engaged with the engagement portion 125 for normally urging the change-over member 120 in a clockwise direction in FIGS. 5 and 6.

The stop assembly S is disposed at a right side of the change-over member 120. The stop assembly S is pivotally movable about the support shaft 155 which is a pivot shaft of the change-over member 120, and includes a first stop member 130 and a second stop member 140.

The first stop member 130 includes a cylindrical shaft portion 131 and a third arm 132 extending rearward from the shaft portion 131. The third arm 132 has a free end provided with a hook 132*a* engageable with and disengageable from the stop gear teeth 82*c* of the output gear 82. The third arm 132 has a lower edge portion formed with a spring seat portion 133 with which an upper arm 152*b* of a torsion spring 152 (second urging member, FIG. 8) is seated. The third arm 132 has a base portion functioning as an abutment portion 134 extending radially outwardly from the shaft portion 131.

The abutment portion 134 is adapted to abut against a projection 146 (described later) of the second stop member 140, so that the relative posture between the first stop member 130 and the second stop member 140 can be constantly maintained as a result of pivotal movement of the second stop member 140. A combination of the projection 146 and the abutment portion 134 functions as a restricting portion that restricts relative pivot movement between the first and second stop members 130 and 140.

The second stop member 140 includes a cylindrical shaft portion 141, a fourth arm 142 extending frontward from the shaft portion 141, and a spring support arm 143 extending rearward from the shaft portion 141. The shaft portion 141 extends into the shaft portion 131 so that shaft portion 141 and the shaft portion 131 are coaxially therewith and relatively rotatable. Further, the support shaft 155 fixed to the main body coaxially extends into the shaft portion 141, so that both the shaft portion 131 and the shaft portion 141 are pivotally movably supported to the main body.

The fourth arm 142 extends toward the first cam portion 96*b* of the switching gear 96, and has a tip end portion in direct confrontation with the first cam portion 96*b*. The spring support arm 143 includes a support post 144 extending through a coil portion 152*a* of the torsion spring 152 and an arm support portion 145 for supporting a lower arm 152*c* of the torsion spring 152. The shaft portion 141 has an upper portion provided with the above-described projection 146 projecting rightward therefrom.

The stop assembly S including the first stop member 130 and the second stop member 140 defines a center of gravity positioned offset from (rightward from in FIG. 8) an axis of the support shaft 155 during the stopping phase of the pressure plate. That is, these first stop member 130 and second stop member 140 are shaped and sized to provide such weight balance. With this weight balance, the stop assembly S is urged to be pivotally moved in a clockwise direction in FIG. 8 to disengage the hook 132*a* from the output gear 82, if the fourth arm 142 which has been contacting with the first cam portion 96*b* is displaced from the first cam portion 96*b* (is entered into a space of the recessed portion 96*f*) as a result of the rotation of the first cam portion 96*b*. The change-over member 120 and the stop assembly S are both pivotally movable about the support shaft 155 independent of each other.

Figure 7:
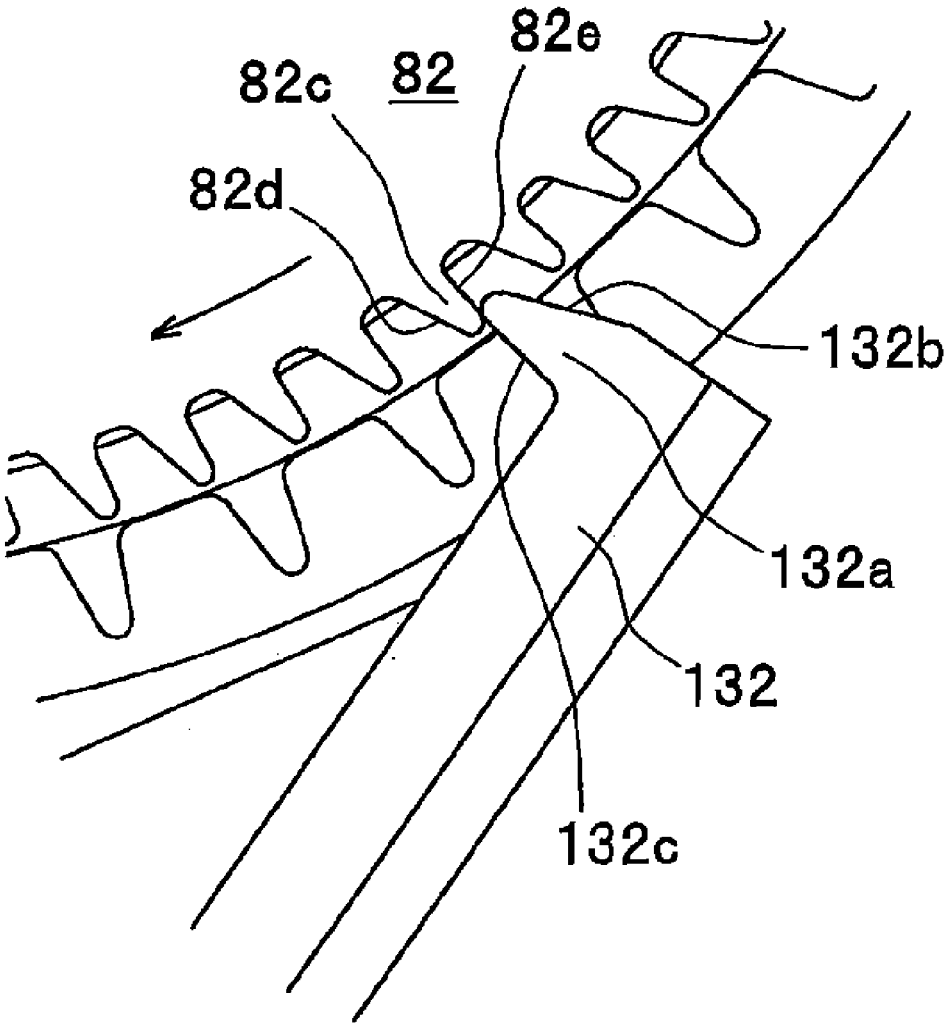
FIG. 7 is an enlarged view of a portion X marked by a broken line circle X of FIG. 5 according to the embodiment.

As shown in FIG. 7, each of the stop gear teeth 82*c* of the output gear 82 has a forward face 82*d* and a rear face 82*e* in a rotational direction of the output gear 82 (in the clockwise direction in FIG. 7). The forward face 82*d* and rear face 82*e* are inclined rearward in the rotational direction from a base portion of each tooth to a radially outer end portion thereof. Here, the inclination of the forward face 82*d* with respect to the radial direction of the output gear 82 is steeper than that of the rear face 82*e*. On the other hand, the hook 132*a* of the third arm 132 has a hook face 132*c* and a slippage face 132*b* positioned rearward of the hook face 132*c* in the rotational direction. Both the slippage face 132*b* and the hook face 132*c* are inclined frontward in the rotational direction from the base end portion to the free end portion of the hook 132*a*. Here the inclination of the slippage face 132*b* with respect to the radial direction of the output gear 82 is steeper than that of the hook face 132*c*.

With this structure, the forward face 82*d* and the slippage face 132*b* are contacted with each other to urge the third arm 132 to be moved away from the output gear 82, when the output gear 82 is rotated by the driving force from the driving force input gear 110. That is, the contact of the slippage face 132*b* with the forward face 82*d* will release the locking of the hook 132*a* against the output gear 82 when the rotation of the output gear 82 is started by the driving force from the driving force input gear 110.

On the other hand, the rear face 82*e* is urged to be engaged with the hook face 132*c* as long as the hook 132*a* is entered between the neighboring stop gear teeth 82*c*, if the output gear 82 is urged to be reversely rotated (the counterclockwise direction in FIG. 7) because of the own weight of the sheet stack 3 and the pressure plate 51 and if the driving force from the driving force input gear 110 is not transmitted to the output gear 82. In this case, meshing engagement between the stop gear tooth 82*c* and the hook 132*a* can be maintained because of the forcible engagement between the rear face 82*e* and the hook face 132*c*. Consequently, descent movement of the pressure plate 51 can be prevented.

As described later in detail, the rotation of the switching gear 96 is controlled in the following manner. In a state where the pressure plate 51 is started to be moved downward from its stopping position, the rotation of the switching gear 96 in clockwise direction in FIGS. 5 and 8 is started as a result of pivotal motion of the first hook 73 and the second hook 74 when the pickup roller 61 is moved downward to a predetermined position. Then, the rotation of the switching gear 96 is temporarily stopped at a predetermined rotation angle when the pressure plate 51 is moved to its elevating position. Then, the rotation of the switching gear 96 is again started by a predetermined angle and is stopped at the pressure plate stopping position. In other words, the stepped portion 96*d* and the protruding portion 96*e* are so designed to provide the above-described rotation control to the switching gear 96.

The first cam portion 96*b* has a cam profile designed to move the change-over member 120 and the stop assembly S at their predetermined pivotally moving pattern during the contact of the second arm 123 of the change-over member 120 and the fourth arm 142 of the second stop member 140 with the first cam portion 96*b*. More specifically, the cam profile of the first cam portion 96*b* is designed to permit at least one of the first arm 122 and the third arm 132 to be engaged with the clutch gear mechanism 80 (i.e., with the trigger 83 or with the output gear 82). In the present embodiment, the following operational order is realized by the first cam portion 96*b*.

(1) At the pressure plate stopping position, the first arm 122 is urged to be released from the trigger 83, while the third arm 132 is urged to be engaged with the output gear 82.

(2) After starting the rotation of the switching gear 96 in the clockwise direction from its pressure plate stopping position, the first arm 122 is urged to be engaged with the trigger 83, and then, the third arm 132 is urged to be moved away from the output gear 82.

(3) After again starting the rotation of the switching gear 96 from its pressure plate elevating position where the third arm 132 is released from the output gear 82, the third arm 132 is again brought into engagement with the output gear 82 while the first arm 122 is engaged with the trigger 83, and then, the first arm 122 is released from the trigger 83.

Incidentally, the cam profile of the first cam portion 96*b* may accompany useless or wasted operation as long as the above described operational sequence can be maintained. For example, regarding the operation (2), the first arm 122 can be temporarily released from the trigger 83 after the first arm 122 is engaged with the trigger 83, and immediately thereafter, the first arm 122 is again engaged with the trigger 83, and then, the third arm 132 is urged to be moved away from the output gear 82.

Figure 12:
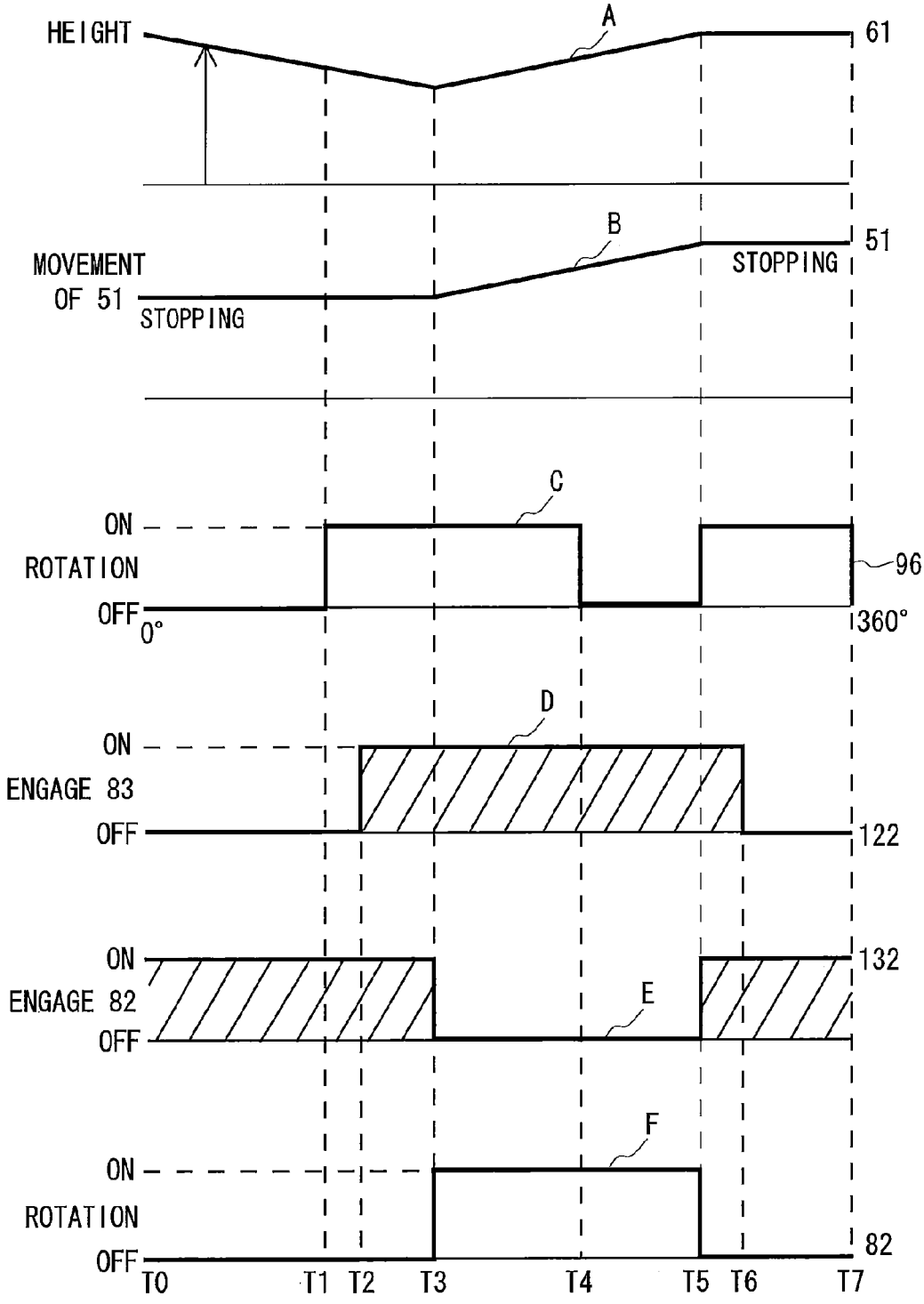
FIG. 12 is a timing chart showing operation timings of various components according to the embodiment.

Next, an operation in the above-described laser printer 1 will be described with reference to a timing chart shown in FIG. 12. For the printing operation, the driving force input gear 110 is rotated at all times. In the timing chart, "A" represents upward/downward movement of the pickup roller 61, "B" represents pivotal motion of the pressure plate 51, "C" represents rotation timing of the first cam portion 96*b*, "D" represents engaging timing of the first arm 122 with the trigger teeth 83*b* of the trigger 83, "E" represents engaging timing of the third arm 132 with the stop gear teeth 82*c* of the output gear 82, and "F" represents rotation timing of the output gear 82.

The pickup roller 61 is at the elevated position if a sufficient amount of sheets 3 is stacked on the sheet supply tray 11. Therefore, the right end portion of the lift arm 71 is moved upward whereas the left end portion 71*c* of the lift arm 71 is moved downward in FIG. 3. In this state, the pressure plate controlling mechanism is at the pressure plate stopping position shown in FIG. 8. In the stopping position, the rotation of the switching gear 96 (in the clockwise direction in FIG. 8) is prohibited since the tip end of the rear arm 73*b* of the first hook 73 is engaged with the protruding portion 96*e*. Further, the external gear teeth 81*b* of the input gear 81 is in confrontation with the non-toothed region 96*j* of the switching gear 96. Therefore, rotation of the input gear 81 cannot be transmitted to the switching gear 96.

Further, the second arm 123 of the change-over member 120 and the fourth arm 142 of the stop assembly S are in contact with the basic circle of the first cam portion 96*b*. Therefore, the first arm 122 of the change-over member 120 is disengaged from the trigger 83, while the third arm 132 of the stop assembly S is engaged with the stop gear teeth 82*c* of the output gear 82. Because of the disengagement of the first arm 122 from the trigger 83, the trigger 83 can be freely rotated, so that rotation of the input gear 81 by the rotation of the driving force input gear 110 is not transmitted to the output gear 82. Weight of the sheet stack on the pressure plate 51 generates force to rotate the output gear 82 in the counterclockwise direction. However, the rotation of the output gear 82 can be prohibited because of the engagement between the third arm 132 with the output gear 82, thereby preventing the pressure plate 51 from moving downward. As described above, the stop gear teeth 82*c* and the hook 132*a* are urged to be engaged with each other if the output gear 82 is urged to be rotated in the counterclockwise direction. Therefore, disengagement of the hook 132*a* from the output gear 82 can be prevented thereby effectively avoiding downward movement of the pressure plate 51. See T0 to T1 in FIG. 12.

Figure 9:
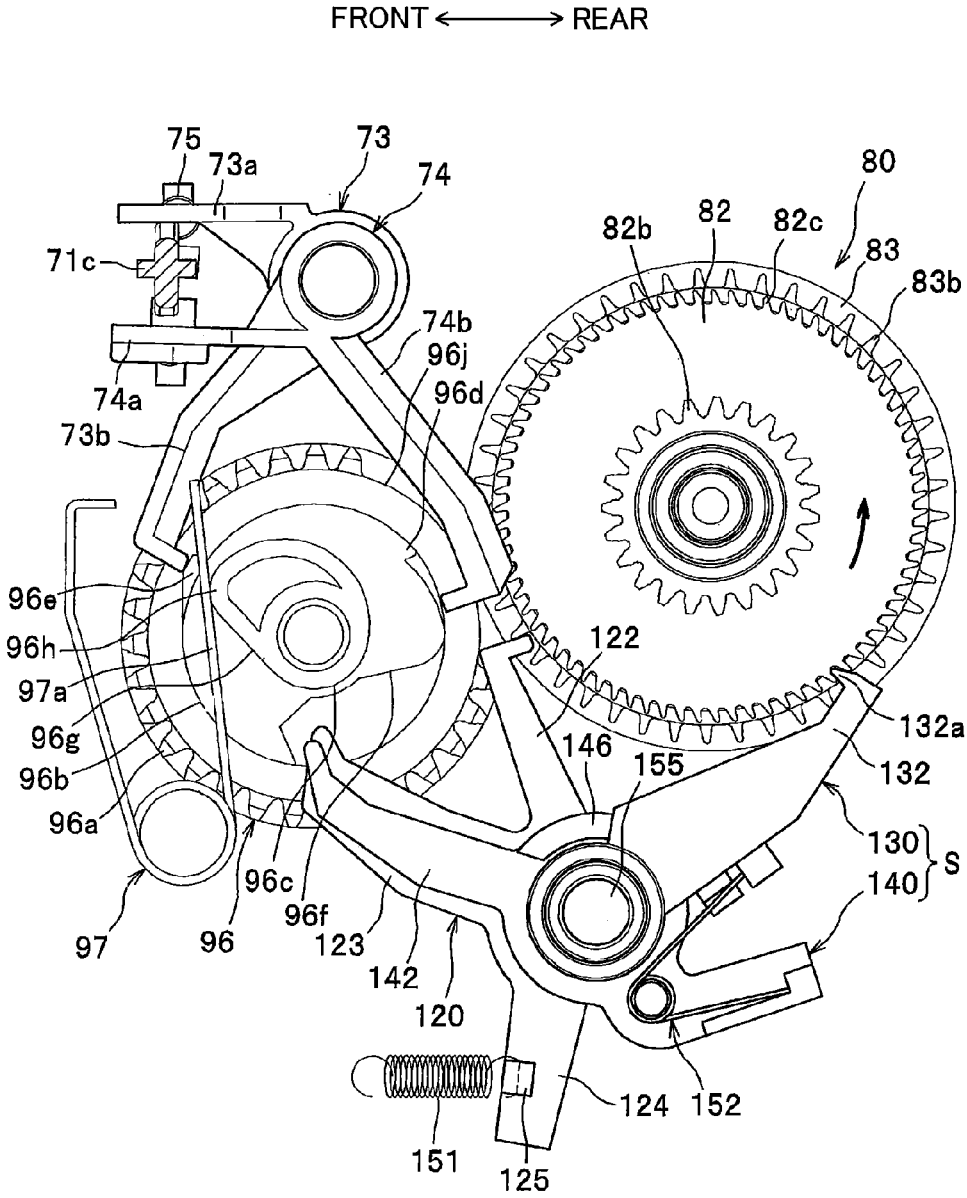
FIG. 9 is an explanatory view showing a state of the pressure plate controlling mechanism immediately prior to elevation of the pressure plate according to the embodiment.

The pickup roller 61 will be moved downward in accordance with lowering of the height of the uppermost sheet of the sheet stack to a predetermined height due to the consumption of the sheets 3 by a predetermined amount (A: T1). Accordingly, the right end portion of the lift arm 71 is moved downward whereas the left end portion 71*c* of the lift arm 71 is moved upward, whereupon the front arm 73*a* of the first hook 73 is lifted upward. Consequently the rear arm 73*b* disengages from the protruding portion 96*e*, so that the switching gear 96 is urged to be rotated (C:T1) in the clockwise direction in FIG. 9 by the urging force of the torsion spring 97, since the arm 97*a* of the torsion spring 97 pushes the end portion 96*h* of the second cam portion 96*c* integral with the first cam portion 96*b*.

By this clockwise rotation, tip end portions of the second arm 123 and the fourth arm 142 are displaced from the basic circle of the first cam portion 96*b* and are brought into confrontation with the recessed portion 96*f*. Therefore, the third arm 132 is urged to be moved away from the output gear 82 (E:T3), because the center of gravity of the stop assembly S is positioned rearward of the axis of the support shaft 155 as described above. On the other hand, the tip end portion of the first arm 122 is rapidly brought into engagement with the trigger teeth 83*b* of the trigger 83 by the pivotal movement in the clockwise direction in FIG. 9 (D:T2) because of the urging force of the spring 151.

The rotation of the input gear 81 can be transmitted to the output gear 82 upon engagement of the first arm 122 with the trigger 83, and thus, the output gear 82 begins to rotate in the clockwise direction in FIG. 10 (F:T3). By this rotation, the forward face 82*d* of the stop gear teeth 82*c* pushes the slippage face 132*b* of the hook 132*a* of the third arm 132 (see FIG. 7), so that the third arm 132 is urged to be moved downward and is urged to be pivotally moved in the clockwise direction in FIG. 10.

The torsion spring 152 interposed between the spring support arm 143 of the second stop member 140 and the third arm 132 of the first stop member 130 urges the third arm 132 to pivotally move in the counterclockwise direction in FIG. 10 and urges the fourth arm 142 of the second stop member 140 to pivotally move in the clockwise direction, and the fourth arm 142 is moved past the second arm 123 in the space of the recessed portion 96*f*, and is positioned higher than the second arm 123. As a result, the abutting relationship is maintained between the abutment portion 134 and the projection 146, thereby fixing relative posture between the first stop member 130 and the second stop member 140. In this case, a posture of the stop assembly S including the first stop member 130 and the second stop member 140 can be maintained as shown in FIG. 10 because of their weight.

Further, the tip end portion of the rear arm 74*b* of the second hook 74 is engaged with the stepped portion 96*d* of the switching gear 96 for stopping rotation of the switching gear 96 (C:T4). In this way, the pressure plate elevating position is provided after the stop assembly S is disengaged from the output gear 82. The output gear 82 rotates in the clockwise direction as long as the tip end portion of the rear arm 74*b* is engaged with the stepped portion 96*d*. That is, the rotation of the output gear 82 elevates the pressure plate 51 through the pressure plate lift mechanism 90.

The elevation of the pressure plate 51 moves, through the sheet stack, the pickup roller 61 upward to a predetermined height (A T3-T5). Therefore, the right end portion of the lift arm 71 is moved upward, whereas the left end portion 71*c* is moved downward to pivotally move the rear arm 74*b* in the counterclockwise direction in FIG. 10. As a result, the tip end portion of the rear arm 74*b* is disengaged from the stepped portion 96*d*. Consequently, the switching gear 96 rapidly rotates in the clockwise direction in FIG. 10 because the arm 97*a* of the torsion spring 97 pushes the end portion 96*h* of the first cam portion 96*b* (C:T5), and then, the gear teeth portion 96*a* is brought into meshing engagement with the input gear 81. Thus, the rotation of the input gear 81 is transmitted to the switching gear 96 to rotate the latter in the clockwise direction in FIG. 10.

Figure 11:
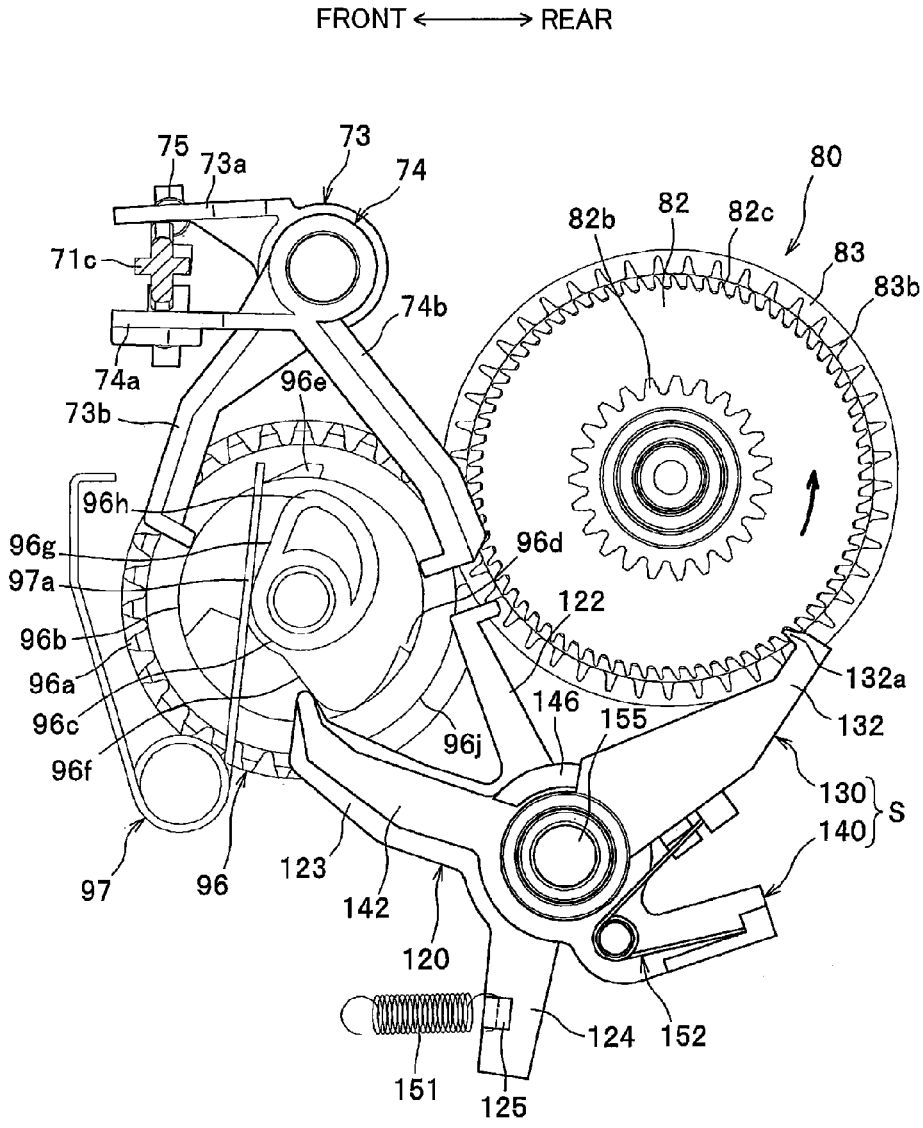
FIG. 11 is an explanatory view showing a state of the pressure plate controlling mechanism immediately prior to stop of the pressure plate according to the embodiment.

In accordance with the clockwise rotation of the switching gear 96, the fourth arm 142 of the stop assembly S is brought into abutment with the recessed portion 96*f* to pivotally move the second stop member 140 in the counterclockwise direction. This pivotal movement causes the first stop member 130 to pivotally move in the counterclockwise direction by the action of the torsion spring 152. Therefore, the hook 132*a* is brought into engagement with the output gear 82 (E:T5). Thereafter, the second arm 123 of the change-over member 120 is brought into abutment with the recessed portion 96*f* to pivotally move the change-over member 120 in the counterclockwise direction. As a result, the tip end portion of the first arm 122 disengages from the 1trigger 83 (D: T6). FIG. 11 shows an initial disengaging phase of the first arm 122 from the trigger 83.

In accordance with the further rotation of the switching gear 96 in the clockwise direction in FIG. 11, the rear arm 73*b* is brought into engagement with the protruding portion 96*e*, and the pressure plate stopping position shown in FIG. 8 can be restored (B:T5) where the external gear teeth 81*b* of the input gear 81 is in confrontation with the non-toothed region 96*j*.

As described above, the first arm 122 which has been engaging with the trigger 83 is disengaged therefrom (D: T6) after the third arm 132 is engaged with the output gear 82 (E:T5), and the third arm 132 which has been engaging with the output gear 82 is disengaged (E: T3) therefrom after the first arm 122 is engaged with the trigger 83 (D: T2). Therefore, at least one of the engagements between the first arm 122 and the trigger 83 and between the third arm 132 and the output gear 82 is provided. Consequently, accidental rotation of the output gear 82 does not occur even if a force originated from the weight of the sheet stack is transmitted to the clutch gear mechanism 80 through the pressure plate lift mechanism 90 and the pressure plate 51. That is, descent movement of the pressure plate 51 due to the weight of the sheet stack does not occur.

In this way, in the laser printer 1 according to the depicted embodiment, control to the movement of the 51 can be performed avoiding accidental descent movement of the pressure plate 51 in spite of non-employment of a one-way clutch.

Further, the present invention does not employ bevel gears and worm gears but employs spur gears. Therefore, high power transmission can result, and a small output drive source is available contributing downsizing of an overall device.

Further, the rotation of the output gear 82 is stopped by the stop assembly S, thereby avoiding descent movement of the pressure plate 51, and the deceleration gears (first and second deceleration gears 91 and 92) are provided next to (downstream side in the power transmitting direction) the output gear 82. Here, a backlash between the stop gear teeth 82*c* and the hook 132*a* leads to a minor descent movement of the pressure plate 51. However, the affect of backlash can be successively reduced because of the deceleration gears, thereby reducing descent movement of the pressure plate 51.

Further, the gear wheel having the stop gear teeth 82*c* has a diameter greater than that of the gear wheel having the output gear teeth 82*b*, and the number of the stop gear teeth 82*c* is greater than that of the output gear teeth 82*b*. Moreover, the hook 132*a* does not engage the output gear teeth 82*b* but the stop gear teeth 82*c*. Accordingly, the engagement between the hook 132*a* and the stop gear teeth 82*c* can provide a small backlash, thereby reducing descent movement of the pressure plate 51. According to the depicted embodiment, a maximum descent distance due to the backlash is about 0.2 mm. On the other hand, a module (a size of a tooth) of the output gear teeth 82*b* can be increased, thereby sustaining large transmission force.

Further, even if the hook 132*a* is urged to be moved to engage the stop gear teeth 82*c* while the output gear 82 is rotating by the driving force from the driving force input gear 110, the slippage face 132*b* of the hook 132*a* is slipped on the forward face 82*d* so as to urge the third arm 132 to be moved away from the output gear 82. Therefore, excessive load is not imparted on the third arm 132. Further, the rear face 82*e* and the hook face 132*c* are urged to be engaged with each other after insertion of the hook 132*a* into the space of the neighboring stop gear teeth 82*c*, if the power transmission from the driving force input gear 110 to the output gear 82 is shut off. Therefore, engagement between the stop gear teeth 82*c* and the hook 132*a* can be maintained to obviate descent movement of the pressure plate 51.

Various modifications are conceivable. For example, in the planetary gear mechanism of the above-described embodiment, the sun gear, the ring gear and the carrier function as the input gear, the output gear, and the trigger, respectively, in order to provide large deceleration ratio and to invert a rotational direction between the input gear and the output gear with reducing the number of gear wheels. However, the sun gear, the carrier, and the ring gear can function as the input gear, output gear, and the trigger, respectively, and another combination is also available.

Further, in the above-described embodiment, both the second arm 123 and the fourth arm 142 are in contact with the recessed portion 96*f* of the single cam profile of the first cam portion 96*b* to pivotally move these a rms 123, 142. In this case, the fourth arm 142 is brought into contact with the recessed portion 96*f* prior to the contact of the second arm 123 with the recessed portion 96*f* by pivotally moving the fourth arm 142 precedent to the pivotal movement of the second arm 123 making use of the weight balance of the stop assembly S.

Figure 13:
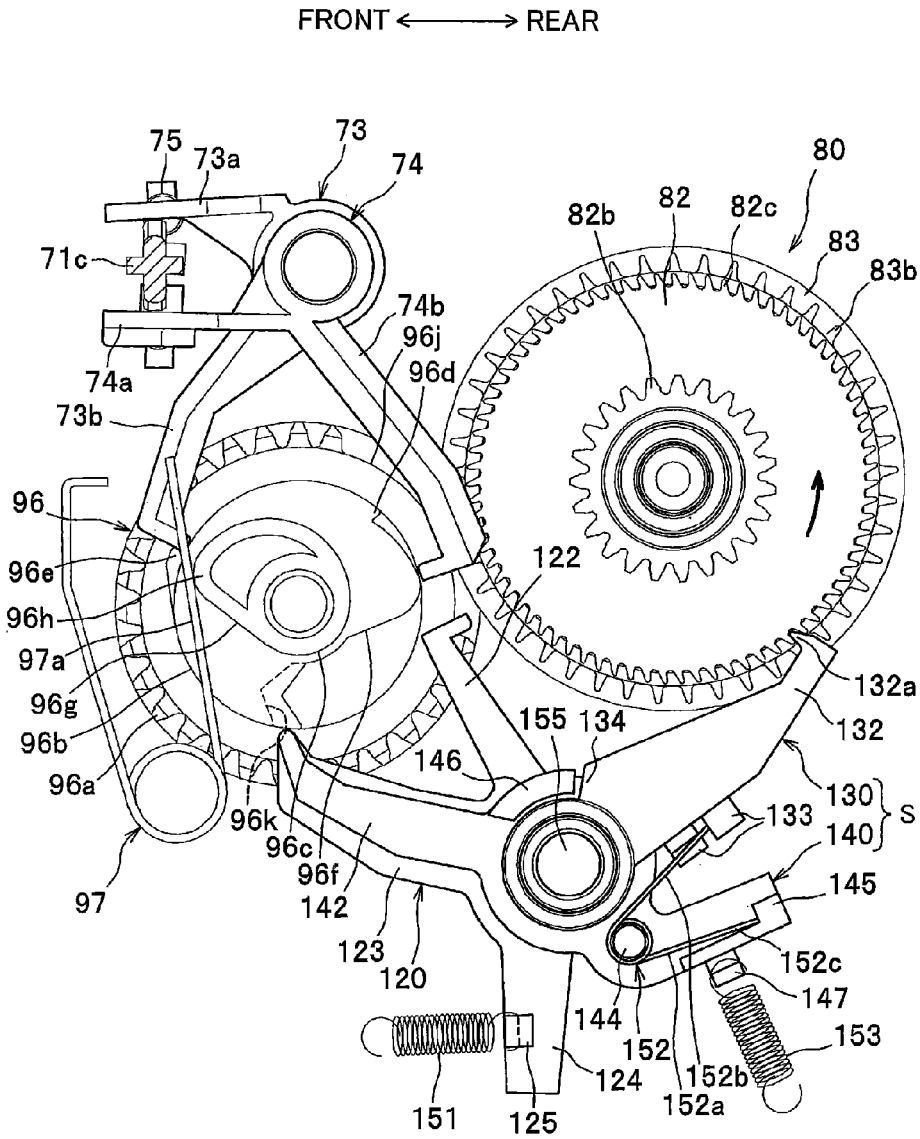
FIG. 13 is a view showing a modification of a stop assembly in which an urging member for urging a third arm is provided.

FIG. 13 shows an alternative structure where a spring 153 is provided to urge the stop assembly in the clockwise direction so that the fourth arm 142 can be moved precedent from the second arm 123 within the space of the recessed portion 96*f*. However, the entry timing of the second arm 123 into the recessed portion 96*f* must be prior to the entry timing of the fourth arm 142 into the recessed portion 96*f*. To this effect, two cam profiles are provided for the trace of the fourth arm 142 and for the trace of the second arm 123, respectively. For example, a cam surface 96*k* as shown in broken line in FIG. 13 is additionally provided exclusively for the second arm 123.

With this structure, when the second arm 123 is entered into a space of the cam surface 96*k*, the fourth arm 142 is still on the first cam portion 96*b*. Therefore, engagement timing of the first arm 122 with the trigger teeth 83*b* can occur prior to the disengagement timing of the third arm 132 from the stop gear teeth 82*c*. However, after the fourth arm 142 is entered into the space of the recessed portion 96*f*, the fourth arm 142 rapidly moves in the space by the urging force of the spring 153, so that the fourth arm 142 is moved past the second arm 123 and reaches the surface of the recessed portion 96*f* prior to the second arm 123 reaching the surface of the recessed portion 96*f*. Therefore, engagement timing of the third arm 132 with the stop gear teeth 82*c* occurs prior to disengagement timing of the first arm 122 from the trigger teeth 83*b*.

Figure 14:
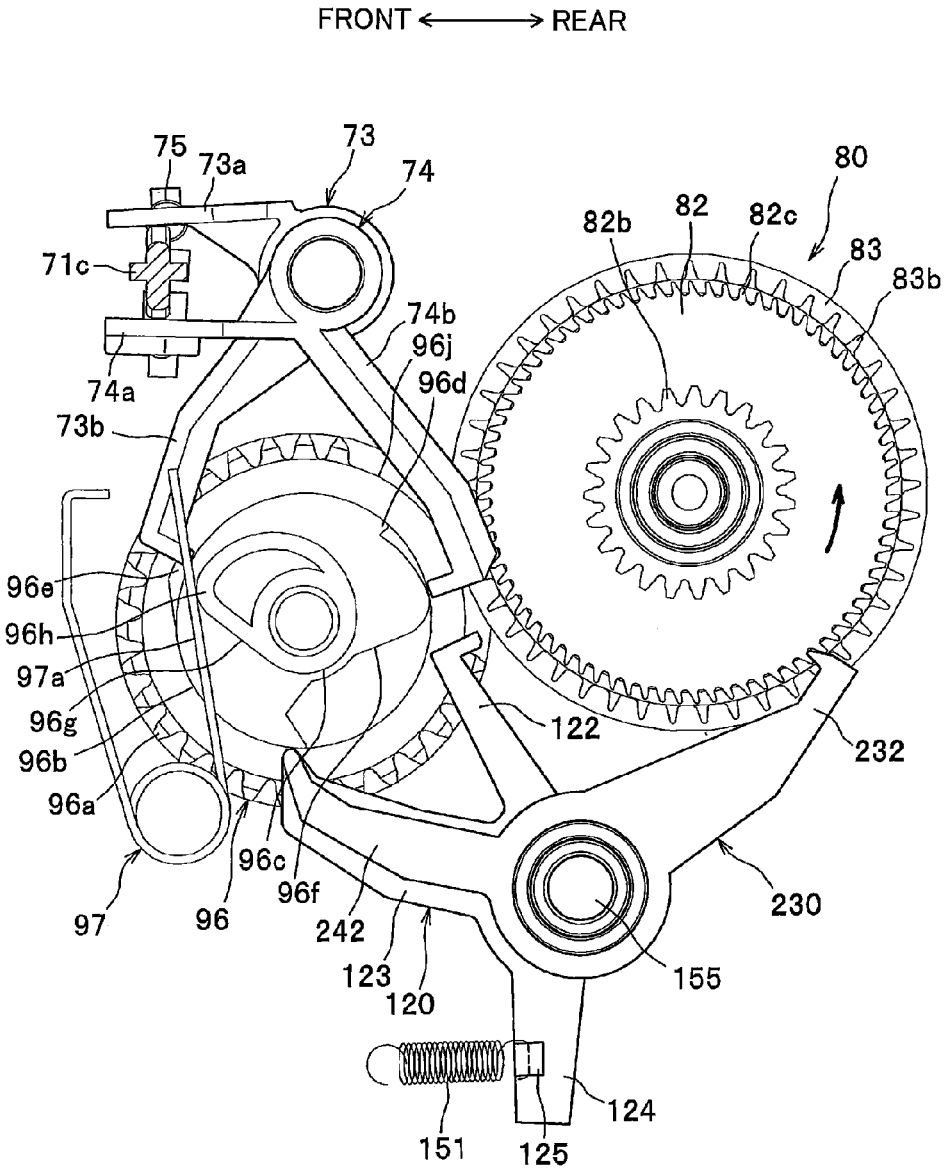
FIG. 14 is a view showing a modification of the stop assembly in which a single component constitutes the stop assembly.

Further, in the above-described embodiment, the stop assembly S is constituted by two members such as the first stop member 130 and the second stop member 140. However, a single stop assembly 230 shown in FIG. 14 is available. The single stop assembly 230 includes a third arm 232 (corresponding to the third arm 132) and a fourth arm 242 (corresponding to the fourth arm 142). With this structure, precise dimensional accuracy is required with respect to an angle between the fourth arm 242 abuttable on the basic circle and the third arm 232 engageable with the output gear 82, and a minute gap must be provided between the fourth arm 232 and the basic circle.

In view of these difficulties, the above-described embodiment is advantageous. That is, in the above-described embodiment, two members such as the first stop member 130 and the second stop member 140 are provided, and the torsion spring 152 (functioning as the second urging member) is interposed between the first stop member 130 and the second stop member 140 for urging the third arm 132 toward the output gear 82 and for urging the fourth arm 142 toward the first cam portion 96*b*. With this structure, unwanted rattling does not occur between the stop assembly S and the first cam portion 96*b*, restraining generation of noise.

In the above-described embodiment, the sheet 3 is a cut paper. However, other sheet such as OHP sheet is also available.

Further, the pressure plate lift mechanism and the pressure plate control mechanism are not limited to the above-described embodiment, and other power transmission mechanism is available.

Further, a digital multi-function device and a copying machine are also available as the image forming device in addition to the laser printer.

While the invention has been described in detail with reference to the embodiment thereof, it would be apparent to those skilled in the art that various changes and modifications may be made therein without departing from the spirit of the invention.

What is claimed is:

1. An image forming device comprising:

a main frame;

a sheet supply tray assembled to the main frame and configured to hold a stack of sheets;

a pressure plate positioned immediately below the stack of sheets when held by the sheet supply tray and movable to a stopping position and to an elevated position for lifting the stack of sheets upward at a sheet supplying timing;

a pickup roller positioned above the sheet supply tray and configured to make contact with an uppermost sheet of the sheet stack held by the sheet supply tray for supplying the uppermost sheet, the pickup roller being movable upward and downward in accordance with an amount of sheets in the sheet stack;

a planetary gear mechanism including an input gear, an output gear, and a trigger member that is configured to selectively transmit rotation of the input gear to the output gear;

a drive source engaged with the input gear and configured to rotate the input gear;

a lift mechanism engaged with the output gear and configured to convert rotary motion of the output gear to a force to lift the pressure plate;

a cam member rotatably supported to the main frame and having a cam portion;

a change-over member pivotally supported to the main frame and pivotally movable, the change-over member comprising a first arm movable between a first position engaging with the trigger member for transmitting rotation of the input gear to the output gear and a second position disengaging from the trigger member for shutting off the transmission of rotation from the input gear to the output gear; and a second arm contactable with the cam portion for moving the first arm between the first position and the second position in accordance with the movement of the pickup roller;

a stop assembly pivotally supported to the main frame and pivotally movable independent of pivotal movement of the change-over member and comprising a third arm pivotally movable between a third position engageable with the output gear for stopping rotation thereof and a fourth position disengaging from the output gear for permitting rotation of the output gear; and a fourth arm contactable with the cam portion for moving the third arm between the third position and the fourth position in accordance with the movement of the pickup roller;

wherein the cam portion has a cam profile configured to position the first arm at the second position and to position the third arm at the third position when the pressure plate is at the stopping position at a stopping phase of rotation of the cam portion, and to position the first arm at the first position after the start of rotation of the cam portion, and then to position the third arm at the fourth position, and to again position the third arm at the third position while maintaining the first position of the first arm after the temporary rotation stop phase and the rotation re-start phase, and then to position the first arm at the second position.

2. The image forming device as claimed in claim 1, wherein the stop assembly is configured to be urged by its own weight such that the third arm is urged toward the fourth position.

3. The image forming device as claimed in claim 2, further comprising an urging member that urges the third arm toward the fourth position.

4. The image forming device as claimed in claim 2, wherein the stop assembly comprises:

a first stop member having the third arm;

a second stop member pivotally movable relative to the first stop member and having the fourth arm;

a second urging member that urges the first stop member and the second stop member to urge the third arm toward the third position and to urge the fourth arm toward the cam portion; and, a restricting portion that restricts relative pivot movement between the first stop member and the second stop member.

5. The image forming device as claimed in claim 1, further comprising an urging member that urges the third arm toward the fourth position.

6. The image forming device as claimed in claim 1, wherein the output gear has stop gear teeth and the third arm has a hook engageable with the stop gear teeth, the stop gear teeth and the hook having shapes to allow the hook to disengage from the stop gear teeth when the output gear is rotated in a driving direction for driving the lift mechanism to lift the pressure plate, and to allow the hook to engage the stop gear teeth when the output gear is urged to be rotated in a direction opposite to the driving direction.

7. The image forming device as claimed in claim 1, further comprising:

a lift arm pivotally supported to the main frame and pivotally movable, the lift arm having one end portion for urging the pickup roller toward the uppermost sheet of the sheet stack, the lift arm having another end portion; and a set of hook members pivotally supported to the main frame and pivotally movable, the set of hook members having first end portions connected to the another end portion of the lift arm, and second end portions, the set of hook members being pivotally moved as a result of a movement of the another end portion of the lift arm, the second end portion being engageable with and disengageable from the cam portion by pivotal motion of the set of hook members for stopping and starting rotation of the cam member.

8. The image forming device as claimed in claim 1, wherein the pressure plate is pivotally supported to the main frame and pivotally movable; and the image forming device further comprising a lifter plate pivotally movable about an axis of a pivot shaft and supported to the main frame, and positioned immediately below the pressure plate for lifting the pressure plate, the output gear being drivingly connected to the pivot shaft.

* * * * *